US006901972B1

(12) United States Patent
Nelson

(10) Patent No.: US 6,901,972 B1
(45) Date of Patent: Jun. 7, 2005

(54) CAPSULE FILLING DEVICE AND METHOD OF OPERATION

(76) Inventor: John Nelson, 519 N. Spring Ave., La Grange Park, IL (US) 60526

( * ) Notice: Subject to any disclaimer, the term of this patent is extended or adjusted under 35 U.S.C. 154(b) by 0 days.

(21) Appl. No.: 10/726,444

(22) Filed: Dec. 3, 2003

(51) Int. Cl.[7] ..... B65B 1/04
(52) U.S. Cl. ..... 141/67; 141/34; 141/247
(58) Field of Search ..... 141/2, 18, 67, 141/34, 144, 234, 247; 53/473, 281, 390

(56) References Cited

U.S. PATENT DOCUMENTS 3,554,412 A * 1/1971 Hayashi et al. ..... 222/346
4,731,979 A * 3/1988 Yamamoto et al. ..... 53/529
5,797,248 A * 8/1998 Hetherington et al. ..... 53/473
6,286,567 B1 * 9/2001 Runft ..... 141/145

* cited by examiner

*Primary Examiner*—Steven O. Douglas

(57) ABSTRACT

A device and method of operation for filling medicine capsules, in which a fixed quantity of open capsules to be filled are supported in a circular array by a holder plate beneath the periphery of a rotatable distribution drum. In use, a measured supply of filling medication, in dry granular form, is dispensed into the center of the rotating drum where it is distributed evenly by centrifugal force along the periphery of the drum. As the drum stops rotating, the medication flows by gravity into the capsules, which are then inspected, closed and packaged. The distribution of filler material is more even than if the capsules were filled by hand, and the average quantity (both by volume and by weight) of the filling material per capsule in the batch is variable to suit an individual patient's needs, and very accurately known. In addition, two or more compatible filler medications may be mixed in the same capsules to suit the specialized needs of a particular user. Because the provided quantity of medication is completely distributed into each batch of capsules, inadvertent double-filling is prevented.

14 Claims, 4 Drawing Sheets

CAPSULE FILLING DEVICE AND METHOD OF OPERATION

FIELD OF THE INVENTION

This invention relates in general to capsule filing devices, and more particularly to mechanical capsule filling devices adapted to fill small quantities of capsules, such as a single prescription, with the exact kinds and amounts of medications required to meet the needs of one particular patient.

BACKGROUND OF THE INVENTION

Medicines and pharmaceutical substances are generally manufactured in tablet or capsule form in pre-determined dosages chosen from a relatively limited range, based on the presumptions of the manufacturer as to what dosages are likely to be prescribed by physicians for a majority of their patients. Without a flexible range of doses being is available, the patient is forced to break tablets in half, or to remember complicated dosing schedules, such as having to take two tablets on Mondays, Wednesdays and Fridays, and three tablets on all other days of the week. Because each patient is different, such predetermined dosages are almost invariably an approximation or a compromise relative for what the patient actually needs.

For example, certain psychotropic medications such as lithium carbonate (used to treat bipolar illness) are safe and effective only within a relatively narrow range of dosages based on a variety of factors including the patient's age, body weight, drug elimination rate, general health, and tolerance to the particular medication prescribed. If the dosage is too low, as reflected by the concentration of the medication in the patient's blood, its threshold of effectiveness may not have been reached and the patient will enjoy no benefits. On the other hand, if the dosage is too high, while the patient may be relieved of his or her symptoms, serious symptoms of toxicity or other intolerance to the medication may result.

Other situations in which a variable, continuously adjustable dose would be of benefit to both the prescribing physician and the patient include dosage adjustment based on serum or plasma concentration of drugs having a relatively narrow therapeutic window, such as (for example) theophylline, digoxin, and many anticonvulsants, including phenobarbital and dilantin, as well as drugs with a variable and unpredictable patient response such as the immunosuppressants methotrexate, prednisone and cyclosporine.

The invention is of particular benefit to the practice of veterinary medicine, in which the physician encounters wide extremes of size and species. It also benefits research pharmacists who are required to prepare small batches of capsules with various fillers for purposes of stability testing, analytical assay, reference material, clinical trials and dissolution studies.

For these reasons it would be highly advantageous if the prescribing physician could be able to prescribe medications in filled capsules which are individually tailored to the needs of each patient in terms of both type of medication (including combinations of drugs) and dosage. For this purpose, the present invention provides a capsule filling device capable of filling capsules with any filler material, particularly dry flowable powdered or micro-encapsulated medication in any dosage desired. In addition, it allows for filling individual groups of capsules with specific doses of one or more medications.

The prior art includes a variety of capsule filling devices and methods of operation which accomplish the task of measuring and distributing dry flowable medications into individual capsules. One example is U.S. Pat. No. 5,797,248 which discloses a manual capsule filling device in which a known quantity of dry material, such as from a bottle in which the weight of the contents is known, is emptied into a reservoir which overlies a rotary dosage plate containing a plurality of spaced cavities, each cavity being of a known volume. The medication is allowed to flow into and fill the cavities, whereupon the dosage plate is rotated to transfer its contents into individual capsules below. The capsules are then capped and replaced by empty capsules, and the operation is repeated as many times as is necessary to fill the required number of capsules.

However, this system has several disadvantages, such as the inability to fill capsules by weight instead of volume, and the inability to change the dosage without emptying the device and changing the dosage plate.

Another manual capsule filling device is shown in U.S. Pat. No. 5,660,029 in which is empty capsules are placed in cavities in a funnel-shaped tray. A known quantity of medication is placed in the tray and raked or swept into the capsule, such as by tilting or tapping the tray, after which the capsule contents are compressed by tamping before the capsule is capped. The tamping tool is also useable to remove the filled capsules from their cavities.

Mentioned in U.S. Pat. No. 5,797,248 are other examples of similar prior art. Canadian Patent 494,695 shows a capsule filling device in which a measured amount of pharmaceutical is placed on a spreader plate with wells, the depth of the wells being adjustable. The pharmaceutical is spread into the wells until it is flush with the tops of the wells, the spreader plate is covered with a funnel system and turned upside down to allow the dry medication to funnel into the capsules. U.S. Pat. No. 5,321,932 shows a device to open and close capsules so that they may be filled, however, the method of filling the capsules is not described. U.S. Pat. No. 4,619,336 provides a method and apparatus for weighing doses of powder in which powder is fed onto a weigh scale which stops the powder flow just below the desired weight, at which point remaining powder is allowed to run into the weighing receptacle.

Highly mechanized devices for filling capsules in mass production are also shown in the prior art, such as U.S. Pat. Nos. 6,170,226, 5,490,702, 5,018,335 and 4,964,262, and 4,731,979, but all of these machines lack the flexibility and adaptability of the present invention because they depend on a mechanical or pneumatic charging system which must be re-set, re-calibrated and re-tested every time a new and different batch of capsules is run.

SUMMARY OF THE INVENTION

A principal object of the present invention is to provide an improved capsule filling device which is easily and quickly adaptable to filling small batches of capsules with predetermined quantities of medication intended to fill the needs of a specific patient and prescription. A related objective is to replace the tedious and laborious task of hand measuring and filling each batch of capsules, with its resultant inconsistencies and opportunities for error, with a small scale but relatively high speed process which is adaptable to computer monitoring and control, and which permits the creation and retention of a detailed record of each batch of capsules processed.

Another object is to provide a capsule filling device and method of operation in which a measured quantity of medication is distributed evenly by centrifugal force from any suitable power means, such as an electric motor, into a predetermined number of capsules, so that the total amount of medication supplied to the group of capsules as a whole is accurately known, with little or no waste. This allows a pharmacist to easily fill prescriptions on an individual basis, with a consequent decrease in inventory, and reduction of dispensing errors. The reduction in inventory will help insure that the dispensed pharmaceuticals are always "fresh". Tailor-made or "custom" prescriptions containing two or more pharmaceuticals in combination can be easily dispensed in controlled batches.

A related object is to provide a capsule filling device with a minimum of moving parts, all of which may be conveniently removed for cleaning or sterilizing. Thus the device can be quickly and easily prepared for filling the next batch of capsules with a different medication, or with a different dosage, to suit the individual needs of a different patient. A further related object is to provide means for quickly and positively ejecting filled and covered capsules from the device by power means, such as compressed gas.

Another principal object is to provide a powered capsule filling device having an electronic control system for controlling, monitoring, and recording each batch of filler material and associated capsules, whereby a detailed record is created automatically to confirm and verify the filling of each such batch. By controlling and monitoring the filling of each batch of capsules by electronic means, the processing of each batch will leave behind an "audit trail" for the protection of the physician and the pharmacist as well as the patient.

BRIEF DESCRIPTION OF THE DRAWINGS

A detailed description of two embodiments are provided herein below with reference to the following drawings, in which.

Figure 1:
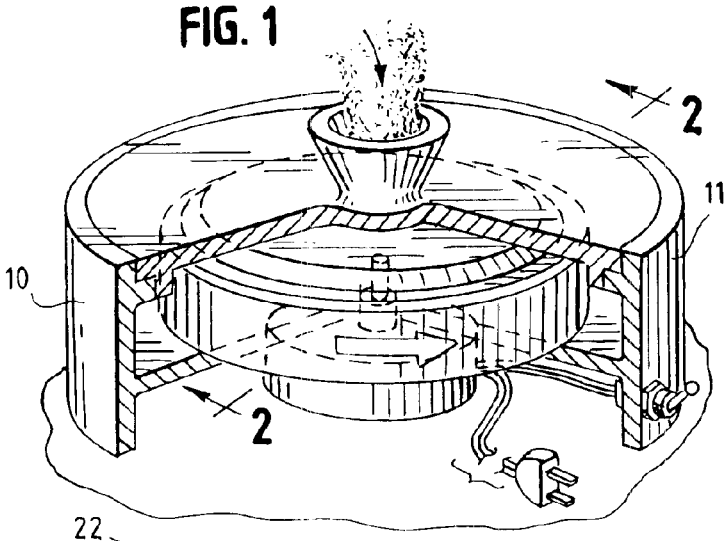
FIG. 1 is a partial sectional perspective view of a first preferred embodiment of the capsule filling device of the present.
Figure 3:
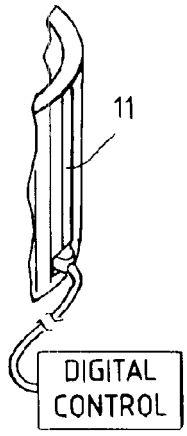
FIG. 3 is a fragmentary view of an alternative construction of the embodiment of FIG. 1.

In the drawings, the two embodiments of the invention are illustrated by way of example. It must be understood that the description and drawings are only for the purpose of illustration and as an aid to understanding, and are not intended as a definition of the limits of the invention.

DETAILED DESCRIPTION OF THE PREFERRED EMBODIMENTS

Two preferred embodiments of the present invention are described. While both incorporate all of the major features of the invention, they differ in their internal construction, particularly as regards to means by which the unfilled capsules are held and retained by the rotating elements of the device.

Figure 2:
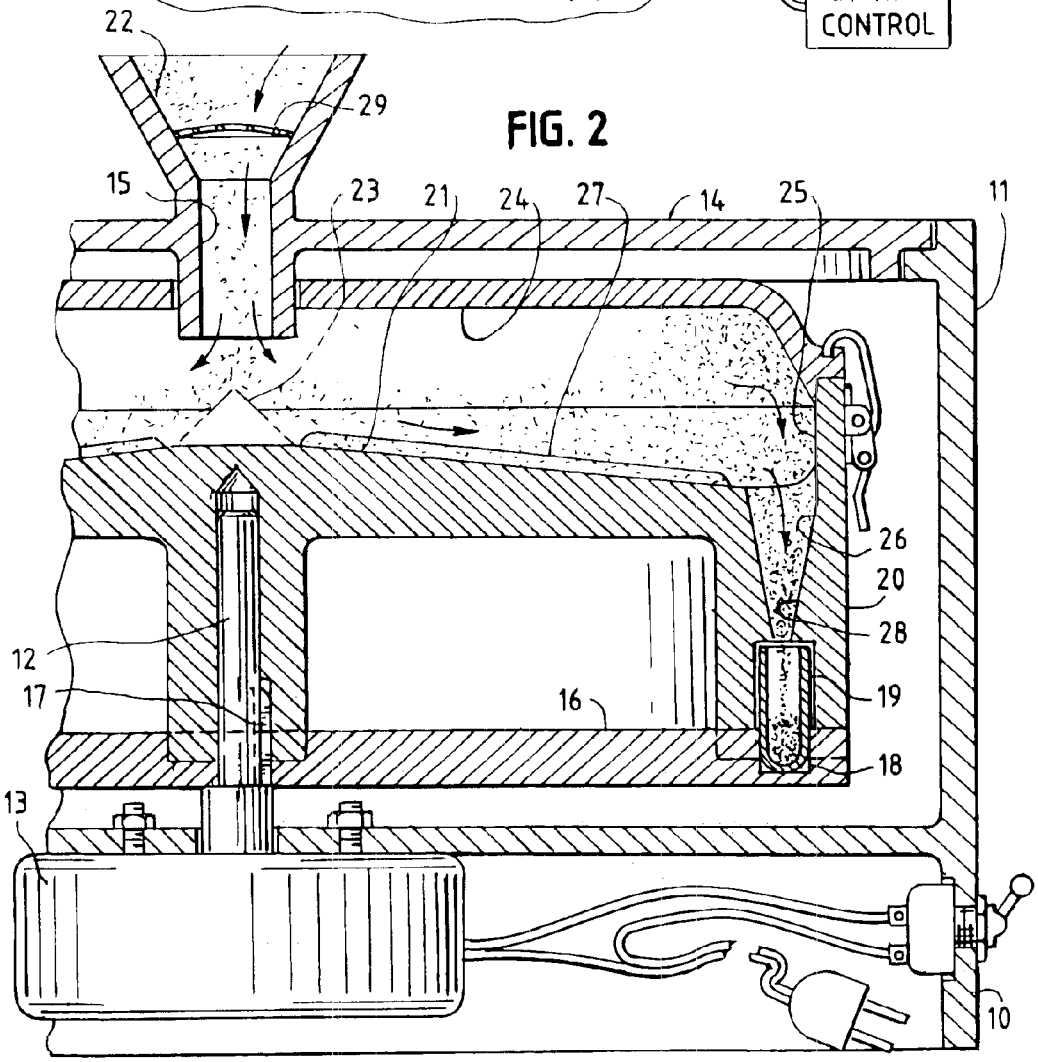
FIG. 2 is a partial sectional elevation of the first embodiment of FIG. 1.
Figure 4:
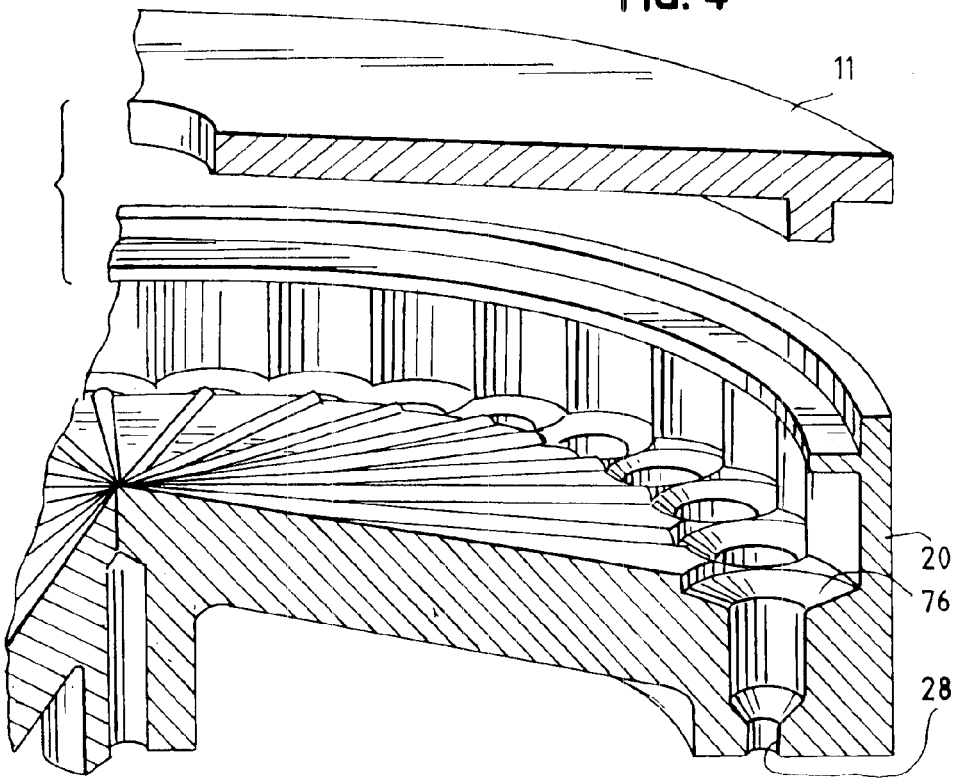
FIG. 4 is an enlarged partial sectional perspective view of the device of FIG. 1, particularly illustrating the peripheral capsule receptacles, impeller plate and radial guide ribs.

Referring to the first preferred embodiment of FIGS. 1 and 2 , there is shown a device for filling empty medicine capsules comprising a base 10 supporting an enclosure 11 within which is located a central shaft 12 driven by a power means 13, which in the illustrated embodiment is a variable speed electric motor. The power means 13 may also be a compressed air motor, or a spring-wound mechanism, or a hand crank, or a shaft driven by a separate power unit (not shown).

Atop the enclosure 11 is a removable upper cover 14 having at its center, in line with the central shaft 12, an inlet opening 15 through which any dry flowable material, such as a medicine or pharmaceutical, may be introduced.

Within the enclosure 11 is a rotating assembly consisting of a capsule holder disk 16 removably affixed to the central shaft 12 by a key means 17, or other suitable means, for rotation by the power means 13. The capsule holder disk 16 contains a plurality of spaced hollow capsule holders 18, preferably but not necessarily evenly spaced around its periphery, with each holder 18 adapted to hold an unfilled capsule element 19. Above the capsule holder disk 16 is a distribution drum 20, concentric with the central shaft 12 and inlet opening 15, and having an upper face serving as an impeller plate 21. This plate 21 is positioned to receive material introduced through the removable upper cover 14 through a funnel-shaped receptacle 22 which directs the material onto an impact point 23 at the center of the impeller plate 21. The distribution drum 20 is covered by a lid 24 having an opening concentric with the funnel receptacle 22.

Preferably, the drum 20 is made of inexpensive lightweight injection-molded or blow-molded plastic material, to reduce expense. In practice, it is desirable to produce the drum 20 so inexpensively that it may be disposed of after a single use, to eliminate the need for washing and sterilization, and to prevent cross-contamination of the capsules being filled.

When the impeller plate 21 rotates, the material introduced through the funnel receptacle 22 is thrown outward by centrifugal force against a peripheral collection surface 25 at the inner periphery of the distribution drum 20. The peripheral collection surface 25 is shaped with an upwardly-extending side wall to collect and retain material flung against it by centrifugal force as the distribution drum 20 is rotated by the power means 13.

Incorporated into the distribution drum 20 beneath the peripheral collection surface 25 are individual collection pockets 26, each of which terminates in a funnel-shaped discharge opening immediately above an unfilled capsule 19 element held in a holder 18 of the capsule holder disk 16.

The upper surface of the impeller plate 21 may optionally include a plurality of evenly spaced upstanding radial guide ribs 27 for urging the flowable material outwards under centrifugal force, with the conical upper surface of the drum 20 serving as a flow splitter, dividing the flowing stream of incoming material and forcing it to be distributed in a relatively uniform manner as it is directed by centrifugal force against the peripheral collection surface 25. The peripheral collection surface may optionally have grooves, rigs, indentations or roughened surfaces to prevent filler material from migrating from the impact point.

In use, the invention of the first embodiment (FIG. 1) is utilized by first removing the upper cover 14 and lifting the distribution drum 20 and lid 24 from the shaft 12 to expose the holders 18 in the capsule holder disk 16. An individual unfilled capsule 19 is placed in each holder 18. The distribution drum 20 and lid 24 and upper cover 14 is replaced and the power means 13 energized to start the rotatable assembly (shaft 12 and capsule holder disk 16 and distribution drum 20 and lid 24) rotating.

When the assembly has reached a rotational speed sufficient to adequately and evenly distribute the filler material, a measured quantity of dry flowable pharmaceutical or other material is introduced into the screened opening of the inlet funnel 22. The filter screen 29 prevents clumps of material from dropping onto the impeller plate 21. The material flows by gravity onto the impact point 23 of the impeller plate where it is flung by centrifugal force (and assisted by the radial guide ribs 27 if used) against the peripheral collection surface 25 in a substantially even circumferential distribution.

At that point, when substantially all of the measured quantity of material has been introduced and distributed evenly about the collection surface 25, the power means 13 is de-energized and the rotational assembly is allowed to slow and stop. As it does so, the centrifugal forces of rotation are overcome by the forces of gravity, and the material commences to flow, slowly and evenly, out of the collection pockets 26 and through the funnel-shaped collection pockets 26 into the empty capsules 19, thus assuring that each capsule is filled with substantially the same amount of material.

After the filler material has been completely distributed into the capsules 19 in the manner described above, the cover 14 and lid 24 and distribution drum 20 are removed. At this point the operator may place closures (not shown) on the filled capsules.

Figure 5:
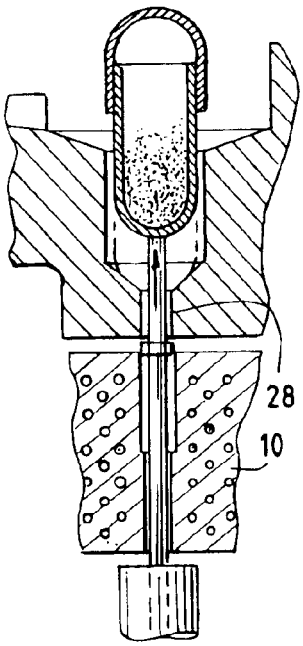
FIG. 5 is an enlarged partial sectional elevation of an alternative construction of the capsule holders of the embodiment of FIG. 1.
Figure 6:
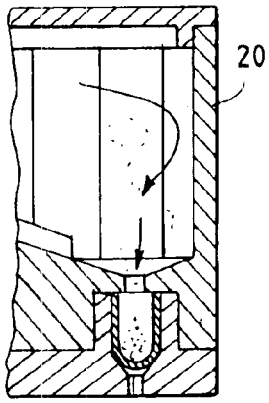
FIG. 6 is a detail sectional elevation showing an alternative construction of the first embodiment of FIG. 1, and further showing the path of a dry flowable material being distributed into a receiving capsule.
Figure 7:
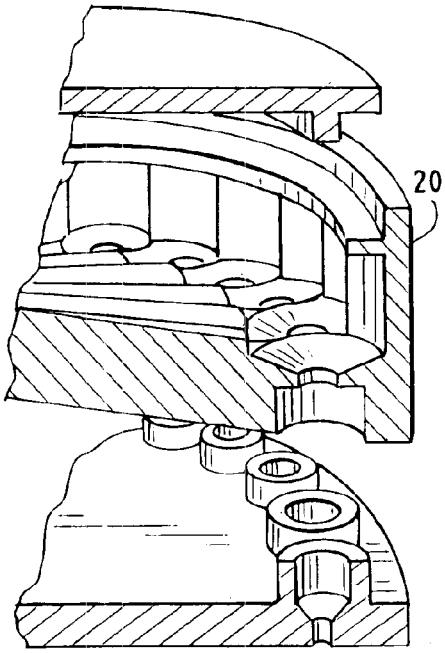
FIG. 7 is a detail sectional perspective of the device of FIG. 1 showing the spatial arrangement of the inner cover, distribution drum, peripheral collection surface, collection pockets and capsule holders.

To aid in holding the capsules 19 in their holders 18, and in ejecting them after they are filled, a channel 28 is provided in the base of each capsule holder 18. A vacuum source (not shown) may be connected to the channel 28 to draw the unfilled capsules firmly into the capsule holder disk 16. After the filling process is completed and the capsules are closed, the channel 28 may either be subject to positive gas pressure or a blunt ejector pin (FIG. 5) may be passed upward through the channel 28 to serve as an ejection means to eject the filled capsules.

An alternative version of this first embodiment is shown in FIGS. 6 , 7 and 8 2, where the distribution drum and capsule holder disk and capsule holders are incorporated in a single unit.

Figure 8:
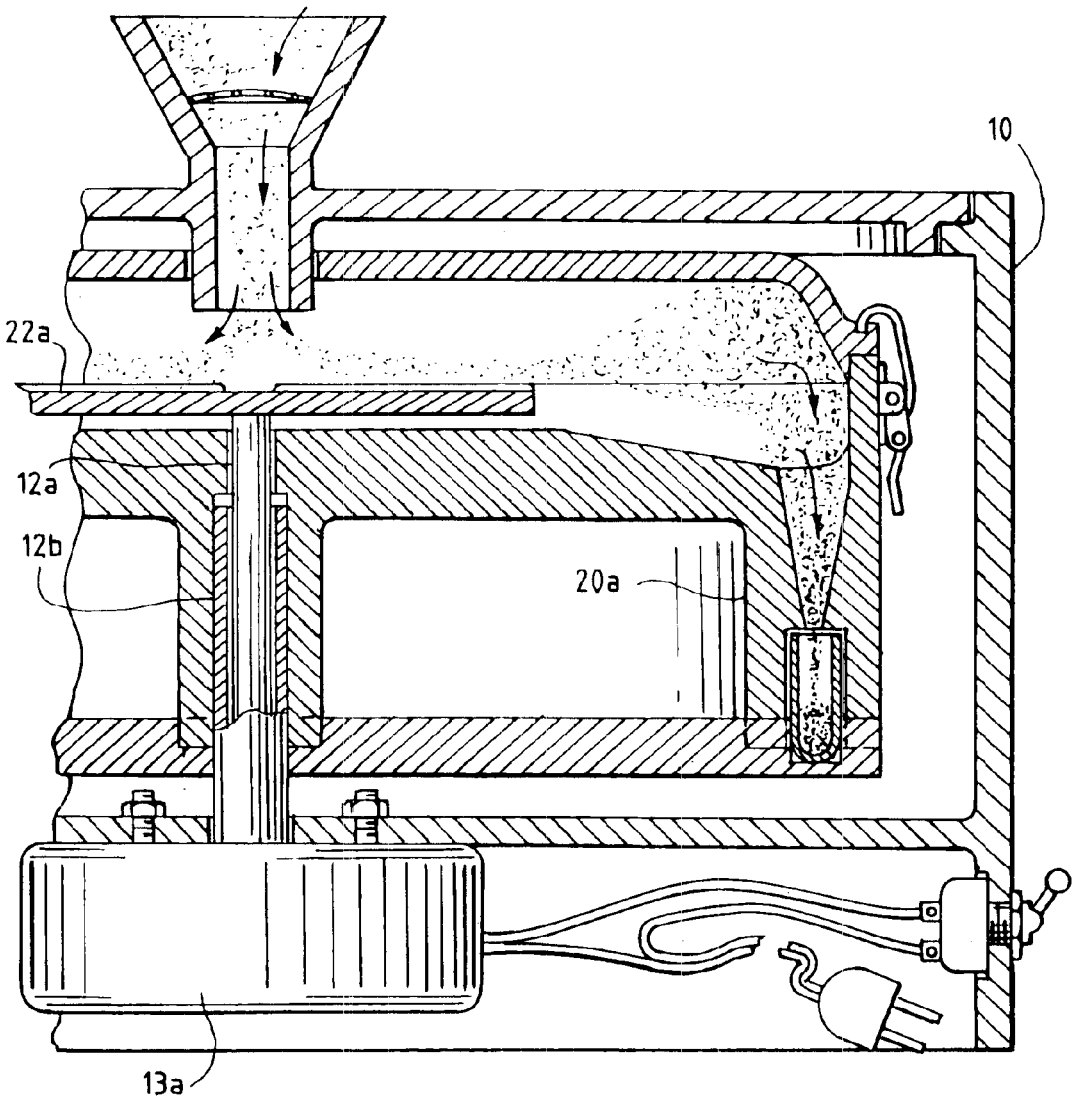
FIG. 8 is a partial sectional elevation of a second embodiment of the invention having an impeller plate which is independently rotatable relative to the distribution drum.

A second embodiment of the invention is shown in FIG. 8, in which the distribution drum 20*a* is physically separate from the impeller plate 22*a*, and driven through a separate inner concentric drive shaft 12*a* which is separately rotatable with respect to the outer drive shaft 12*b*, and can be driven by the power means 13*a* through a selectable ratio transmission means (not shown). This permits the impeller plate to be driven faster, slower, or at the same speed relative to the distribution drum, or (if desired) in a different direction. By this means the device is able to fill capsules with a wider range of sizes and weights of particle sizes.

Figure 9:
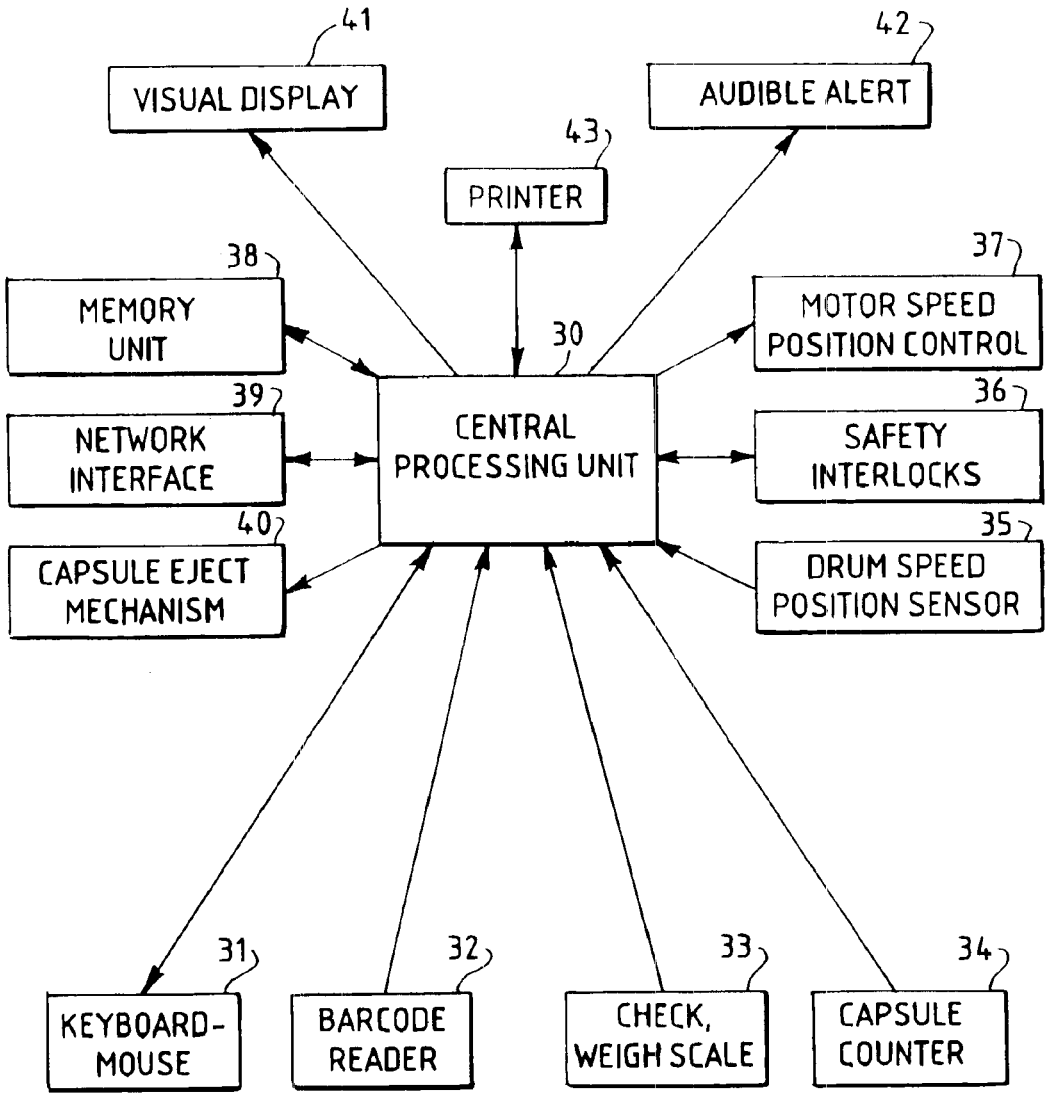
FIG. 9 is a block schematic diagram showing the general relationships of a computer-controlled operating system for the device of the present invention.

Ideally, the device of the present invention may be combined with a microprocessor controller or central processing unit 30 (FIG. 9), with which are associated various data input and output means such as a keyboards and/or mouse 31, barcode reader 32, digital weigh scale 33, capsule counter 34, drum speed and position sensor 35, safety interlocks 36 (to prevent opening during rotation), motor speed and position control 37, a memory unit 38 (to store individual formulation recipes), a network interface 39 (for remote operation), a capsule eject mechanism 40 (associated with an ejection means as previously described), a visual display 41, an audible alert 42 (to signal malfunctions) and a printer 43 for making a hard-copy record of the capsule filling process.

In use, prescription information is received via the various data input means and recognized and recorded by the central processing unit 30. The operator takes note of the information and gathers together the required number of capsules and amount of filler material (or materials) with which to fill the capsules. For verification, the controller may require the operator to scan bottle labels and/or weigh out the prescribed amount of material on a recording scale (not shown), all of which information is recorded by the controller 30 in association with this particular batch of capsules. The controller then permits the operator to energize the power means 13 and fill the capsules, after which it causes a suitable label for the batch of medication to be created by the printer 42.

According to the invention, and as a substantial advantage over the prior art, the emptying of a measured quantity of pharmaceutical material into a predetermined quantity of unfilled capsules insures that the total quantity of medication supplied by that batch of capsules, in response to a single prescription, is in the aggregate exactly the amount specified for that patient for that number of doses and inadvertent double filling of capsules is prevented.

In addition, and as a further advantage of the invention, the filler material for the capsules need not be of a single medication, but can be a combination of various medications in predetermined proportions, to insure that the patient gets exactly the mix of pharmaceuticals prescribed by his or her physician, and without risk that by missing one pill or another the therapeutic mixture of medications will be inadvertently upset or skewed.

Other variations and modifications of the invention are possible. All such modifications or variations are believed to be within the sphere and scope of the invention as defined by the claims appended hereto.

REFERENCE NUMERALS

10. Base
11. Enclosure
12. Central shaft
13. Power means
14. Upper cover
15. Inlet opening
16. Capsule holder disk
17. Key means
18. Spaced capsule holders
19. Unfilled capsule element
20. Distribution drum
21. Impeller plate
22. Funnel receptacle
23. Impact point
24. Lid
25. Peripheral collection surface
26. Collection pocket

27. Radial guide ribs
28. Channel
29. (not used)
30. CPU
31. Keyboard/mouse
32. Barcode reader
33. Digital weigh scale
34. Capsule counter
35. Drum speed and position sensor
36. Safety interlocks
37. Motor speed and position control
38. Memory unit
39. Network interface
40. Capsule eject mechanism
41. Visual display
42. Audible alert
43. Printer

I claim:

1. A device for filling empty medicine capsules with a filler material comprising a) a base having an enclosure and a central shaft having a vertical axis of rotation, b) power means for rotating said shaft within said enclosure, c) a removable upper cover for said enclosure having a central inlet opening coaxial with said shaft, d) a capsule holder disk connectable to said shaft for rotation therewith, and having a plurality of peripherally evenly spaced holders each adapted to receive and support an unfilled open capsule with its open end directed upward, e) a distribution drum associated and aligned with said capsule holder disk for rotation therewith as a unit, said distribution drum having i) a peripheral collection surface, ii) an impeller plate having an impact point concentric with said shaft for receiving filler material introduced at said impact point and flinging it radially against said peripheral collection surface by centrifugal force during rotation, thereby spreading and holding the material in an even layer upon said peripheral collection surface during rotation, and iii) a plurality of uniformly spaced collection pockets in a peripheral array beneath said peripheral collection surface and adapted to receive and collect said filler material flowing by gravity therefrom, each said pocket being generally funnel-shaped with a downward-directed discharge opening aligned with an associated holder of said capsule holder disk, whereby upon the cessation of rotation a substantially equal quantity of filler material flows by gravity from the peripheral collection surface into each collection pocket, and thereafter through the collection pocket discharge openings into each open capsule.

2. The device of claim 1 in which the distribution drum has a removable lid for preventing escape of filler material from the drum, said lid having a central opening for directing filler material onto the impact point of said impeller plate.

3. The device of claim 2 in which the cover has an inlet funnel above said central opening for directing filler material into said opening.

4. The device of claim 1 in which said impeller plate has an upstanding conical flow splitter at its central impact point.

5. The device of claim 1 in which the impeller plate has radial guide ribs for propelling and distributing filler material radially from the central impact point toward the inner collection surface while rotating.

6. The device of claim 1 in which each of the peripherally evenly spaced capsule holders in the capsule holder disk includes a channel for application of vacuum for holding a capsule in each of said holders.

7. The device of claim 6 including of a source of positive gas pressure for ejecting a capsule from each of said holders.

8. The device of claim 6 including an ejector pin controllably introduceable into each of said holders from below.

9. The device of claim 1 in which said central inlet opening includes a filter screen to prevent clumps of material from dropping onto said distribution drum.

10. The device of claim 1 including a microprocessor controller and data input means for providing to the controller information including the number of capsules to be filled, the type of filler material, the speed and duration of drum rotation during a filling operation, and output means for creating a record of said information in the form of a label.

11. The device of claim 1 in which the distribution drum is made of inexpensive molded plastic for one-time use.

12. The device of claim 1 in which the distribution drum, capsule holder disk and capsule holders comprise a single unit.

13. The device of claim 1 in which the distribution drum and impeller plate are separately rotatable at different speeds and directions of rotation relative to one another.

14. The method of filling medicine capsules comprising the steps of a) placing a plurality of unfilled capsules in an evenly spaced peripheral array in a rotatable capsule holder disk with their open ends upward, b) joining said capsule holder disk with a distribution drum having an impeller plate having an impact point concentric with said shaft for receiving filler material introduced at said impact point and flinging it radially against a peripheral collection surface, said distribution drum having a plurality of uniformly spaced collection pockets in a peripheral array beneath said peripheral collection surface, and adapted to receive and collect said filler material flowing by gravity therefrom, each said pocket being generally funnel-shaped with a downward-directed discharge opening aligned with an associated capsule holder of said capsule holder disk, said capsule holder disk and distribution drum forming a rotatable assembly, c) rotating said assembly, and during rotation introducing a known quantity of filler material at the impact point of said impeller plate, whereby the material is flung by centrifugal force substantially uniformly over the circumference of said peripheral collection surface, d) stopping the rotation of said assembly, whereby a substantially equal quantity of filler material flows by gravity from the peripheral collection surface into each collection pocket, and thereafter through the collection pocket discharge opening into each open capsule.

* * * * *